US006598558B2

(12) United States Patent
Griffin

(10) Patent No.: US 6,598,558 B2
(45) Date of Patent: Jul. 29, 2003

(54) PENNANT STRUCTURES, METHODS OF FABRICATING PENNANTS AND METHODS OF AUTHENTICATING PENNANTS

(75) Inventor: Tom Griffin, Baltimore, MD (US)

(73) Assignee: Starbus, Ltd., Baltimore, MD (US)

( * ) Notice: Subject to any disclaimer, the term of this patent is extended or adjusted under 35 U.S.C. 154(b) by 0 days.

(21) Appl. No.: 09/903,774

(22) Filed: Jul. 13, 2001

(65) Prior Publication Data

US 2002/0005003 A1 Jan. 17, 2002

Related U.S. Application Data

(60) Provisional application No. 60/218,174, filed on Jul. 14, 2000.

(51) Int. Cl.[7] ..... G09F 17/00

(52) U.S. Cl. ..... 116/173; 428/542.4

(58) Field of Search ..... 116/173, 174, 116/175; 428/13, 28, 36.1, 36.2, 42.1, 42.2, 42.3, 343, 352, 354, 542.2, 542.4, 542.6, 542.8, 913.3; 442/103, 183, 286, 304, 320, 323; D11/170, 181

(56) References Cited

U.S. PATENT DOCUMENTS

| | | | | | |
|---|---|---|---|---|---|
| D56,970 | S | * | 1/1921 | Hillgardner | D11/168 |
| 1,467,680 | A | * | 9/1923 | Oda | 40/725 |
| D66,981 | S | * | 4/1925 | Perez et al. | D11/168 |
| 1,990,278 | A | * | 2/1935 | Friedmann | 2/115 |
| D134,583 | S | * | 12/1942 | Woodward | D11/168 |
| 3,766,854 | A | * | 10/1973 | Scarlet | 101/211 |
| 3,788,269 | A | * | 1/1974 | Scarlet | 116/173 |
| 3,974,010 | A | * | 8/1976 | Cox, Jr. | 156/93 |
| 4,125,655 | A | * | 11/1978 | Kanzelberger | 428/67 |
| 4,177,750 | A | * | 12/1979 | Scarlet | 116/173 |
| D267,686 | S | * | 1/1983 | Dawson | D6/559 |
| 4,879,145 | A | * | 11/1989 | McLellan et al. | 428/14 |
| D323,257 | S | * | 1/1992 | Cornwell | D6/470 |
| D335,784 | S | * | 5/1993 | Guilfoil, Sr. | D6/470 |
| 5,221,396 | A | * | 6/1993 | Kane | 156/250 |
| D337,460 | S | * | 7/1993 | Tannehill et al. | D6/470 |
| 5,256,490 | A | * | 10/1993 | Pierce | 428/458 |
| 5,364,688 | A | * | 11/1994 | Mahn, Jr. | 428/187 |
| 5,494,735 | A | * | 2/1996 | Nitta | 428/207 |
| D369,042 | S | * | 4/1996 | Kinart | D6/470 |
| 5,635,001 | A | * | 6/1997 | Mahn, Jr. | 156/93 |
| 5,758,588 | A | * | 6/1998 | Orfali | 112/475.08 |
| 5,840,408 | A | * | 11/1998 | Giansetto | 428/190 |
| 5,869,168 | A | * | 2/1999 | Mahn, Jr. | 428/195 |
| 6,082,774 | A | * | 7/2000 | Schlauch | 283/67 |

* cited by examiner

*Primary Examiner*—Diego Gutierrez
*Assistant Examiner*—R. Alexander Smith
(74) *Attorney, Agent, or Firm*—Millen, White, Zelano & Branigan, P.C.

(57) ABSTRACT

Pennants of high quality have first and second exposed layers preferably with a stiffener layer disposed therebetween and bonded thereto. Appliqués are applied to the first layer, the appliqués being in the form of embroidered images of graphic art works or photographs. Direct embroidery is also applied to the first layer. In an embodiment of the invention the embroidered images are embroidered reproductions of photographs which may be applied to the first layer with the pennant either having or not having other layers. The pennant may be mounted in a rigid frame having a triangular shape or rectangular shape.

27 Claims, 5 Drawing Sheets

3
40
10
11
35
12
34
22
18
42
16
3
58
56

3
11
12
52
10
24
50
60
20
44
16
3
58
56

PENNANT STRUCTURES, METHODS OF FABRICATING PENNANTS AND METHODS OF AUTHENTICATING PENNANTS

RELATED APPLICATIONS

U.S. Provisional Application Ser. No. 60/218,174 filed Jul. 14, 2000 from which this application claims priority under 35 U.S.C. §119.

FIELD OF THE INVENTION

The present invention is directed to pennant structure, methods of fabricating pennants and methods of authenticating pennants. More particularly, the present invention is directed to pennants of high quality and durability which have enhanced value as keepsakes and collector's items.

BACKGROUND OF THE INVENTION

Pennants are generally described as triangular flags. They have been used for centuries to convey all sorts of information, sympathies and interests. Pennants may have originally had military uses such as identifying military units and are still used on boats and ships as signals and to convey information. Pennants are now used extensively as ceremonial displays or as displays which celebrate various identifiable athletic teams or perhaps individual athletes. Pennants have become a way to demonstrate ones interest and support of various events such as golf tournaments and a myriad of other contests and events. One way to demonstrate that a person has attended an event is for that person to own, and perhaps display, a pennant.

The pennants currently available generally are items of low quality which do not stand the test of time and after a few years become moth-eaten, unattractive items which are a disparagement to the event, persons, or person which the pennant was originally meant to celebrate. Generally, pennants are inexpensive or even cheap items on which information is printed or perhaps etched onto a low quality felt substrate with little concern as to its original appearance and even less concern to its appearance after passage of time.

Pennants are clearly attractive desirable items, otherwise they would not be in such demand. Accordingly, there is a need for pennants which have an attractive appearance as well as initial and lasting value.

SUMMARY OF THE INVENTION

This invention is directed to a pennant having a first layer with a front surface on which a displayed design occurs and back surface covered by a first thermoplastic backing street. A second layer is provided having a rear surface on which pennant information occurs, the second layer having a front surface covered by a second thermoplastic backing sheet. A stiffener layer is disposed between the first layer and second layer, the stiffener layer being bonded by the first and second thermoplastic backing sheets to the first and second layers.

In a more specific aspect, the first layer is made of a material selected from the group consisting of polyester felt, wool, polyamide, wool blend, leather, cotton and silk, with the stiffener layer being woven polyester.

Preferably, the displays are disposed in at least one decorative area on the first layer and the decorative area is applied thereto as a direct embroidery, an embroidered appliqué, a sublimation or a transfer.

In a further aspect of the invention identifying and authenticating data is affixed to the rear surface of the second layer.

In still other aspects of the invention the pennants are in combination with frames which are triangular or rectangular.

It is also an aspect of the invention to have the pennant associated with a computerized data bank, the data bank including an official authorization statement by an entity endorsing the pennant, a number assigned to the pennant and series data identifying a series of which the pennant is part.

BRIEF DESCRIPTION OF THE DRAWINGS

Various features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
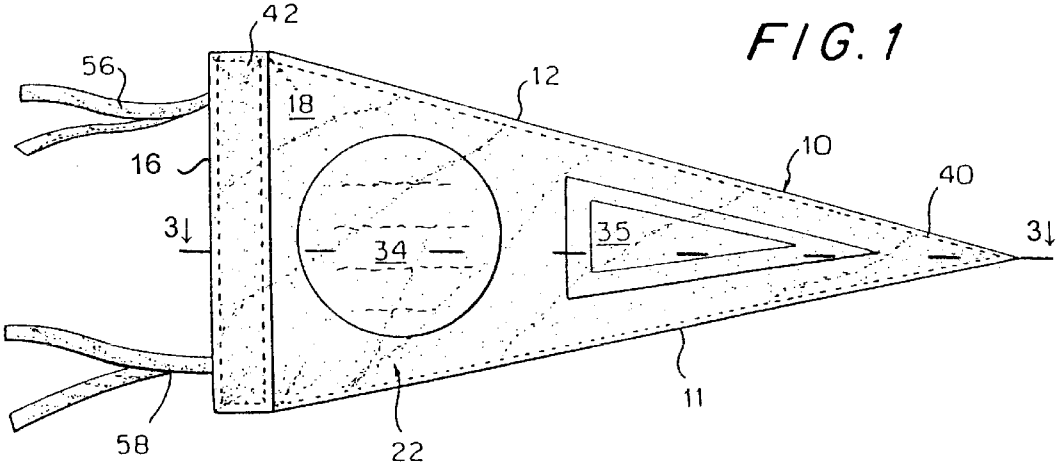
FIG. 1 is a front view of a pennant configured in accordance with the principals of the present invention.
Figure 2:
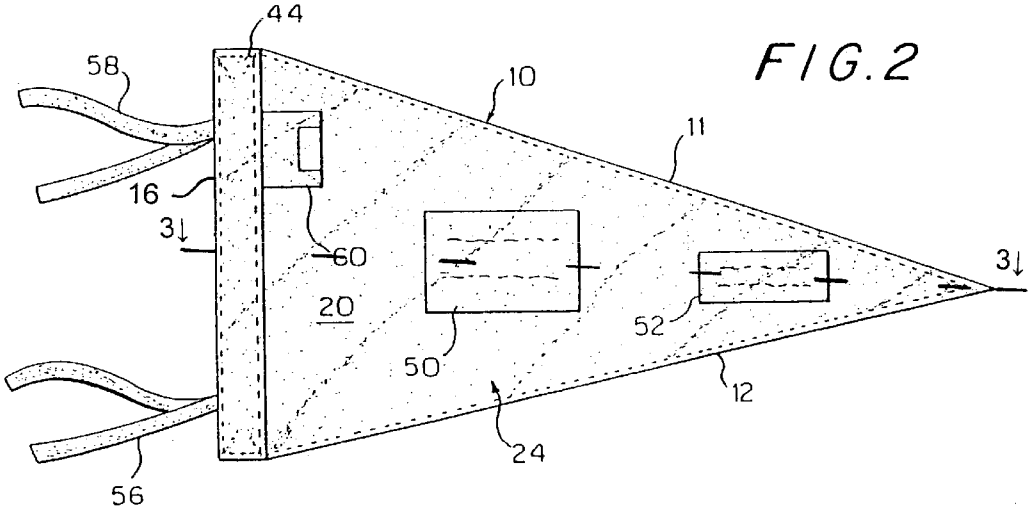
FIG. 2 is a back view of the pennant of FIG. 1.

Referring to FIGS. 1–2 there is shown a pennant 10 configured in accordance with the principals of the present invention. Pennant 10 is in a form of a triangle, preferably an equilateral triangle having first and second converging sides 12 and 14, a base edge 16 and front and back surfaces 18 and 20, respectively. While this triangular shape is the preferred embodiment of the invention, aspects of the invention apply to other shapes as well, for example rectangular, oval, circular or irregular shapes which may be laminated according to the structure and method of FIG. 3.

Figure 3:
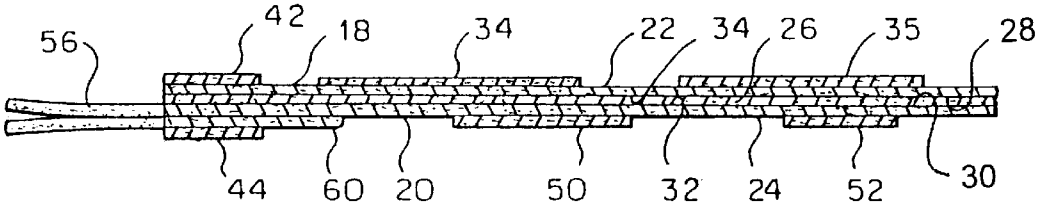
FIG. 3 is a side elevation of the pennant shown in FIGS. 1 and 2 taken along line 3—3.

As is seen in FIG. 3, the pennant is configured as a lamination in which several layers are attached to one another. The lamination is comprised of a first layer 22 having the front surface 18 thereon and a second layer 24 having the rear surface 20 thereon. Disposed between the first layer 22 and second layer 24 is a stiffener layer 26, which is preferably woven of 100% polyester, but can be of other materials or fabrics, either woven or non-woven. The first and second layers 22 and 24 are preferably made of polyester felt on thin thermoplastic backing sheets 28 and 30 respectively.

While polyester felt is the preferred material for the first and second layers 22 and 24 of the pennant 10, other materials may be used such as for example wool, Nylon®, wool blend, leather, cotton, silk or any other fabric or material from which pennants can be made. The thermoplastic backing sheets 28 and 30 are bonded to front and rear surfaces 32 and 34 of the stiffener 26. Preferably, the stiffener 26 is a relatively stiff thermoplastic material such as a woven web of polyester fibers having suitable depth to provide additional weight and resilience to the pennant 10 so as to provide the pennant with a desirable "hand". Since the layers 22, 24 and 26 are heat sealed together to form an integral laminated unit, a tendency for the first layer 22 or the second layer 24 to sag over a period of time is minimized. This is an important property for pennants 10 of this invention since these pennants are frequently displayed on a vertical surface such as a wall.

While it is preferred to have a second layer 24 to cover the back of the pennant 10 there are situations in which the second layer may de deleted. For example the second layer may not be needed if the pennant is mounted in a frame having an opaque backing.

Typically, the front surface 18 provided by the first layer 22 has decorative areas 34 and 35. While two decorative areas 34 and 35 are shown, there maybe but a single decorative area or more than two decorative areas. The surface 18 may also have other indicia or designs thereon. Typically, there is an embroidered appliqué, sublimation or transfer which can be made in layers for a three-dimensional effect. The decorative area 34 can be appliquéd directly to the surface 18 of the first layer 22, can be heat-sealed thereon or directly embroidered therethrough. It can be made of one to three or more layers of felt for a multicolored effect with decorative embroidered stitching. The same artistic arrangements can be made at the triangular area 35 as are made at the area 34 with the areas 34 and 35 having either the same or different types of decorative displays.

In order to enhance the quality and value of the pennants 10, the stiffener 26 (see FIG. 3) provides a barrier so that the backside of the decorative areas 34 and 35 are not seen or tacitly experienced through the back surface 20 of the second layer of 24. For example, embroidering requires that thread be passed through the first layer 22 which makes the thread visible on the backside of the first layer 22. The stiffener 26 prevents any visible indication of embroidery while minimizing or eliminating any tactile presence of embroidery on the backside of the pennant 10. In addition to the design areas 34 and 35, peripheral stitching 40 is provided adjacent the converging edges 12 and 14. Alternatively, the embroidery stitching may also pass through the stiffener 26 and be covered only by the second layer 24. This provides a stiffer substrate through which to embroider and may be useful for very high quality or difficult embroidering situations.

A particularly attractive display is created by using a photograph or graphic artwork and embroidering a display in accordance with the photograph or graphic artwork only onto an appliqué 34 and then embroidering through the periphery of the appliqué and through the stiffener layer to secure the appliqué securely to the front surface 18 of the first layer while obscuring the stitching behind the second layer 24.

It is also within the purview of this invention to apply an appliqué having an image from a photograph or a graphic artwork, such as a drawing or painting, embroidered on the appliqué attached to the first layer 20 of the pennant, wherein the appliqué is affixed only to the first layer by embroidering the border of the appliqué by adhesive or by heat sealing.

To complete the structure on the front surface 18 provided by the first layer 22, a substantially rectangular front end strip 44 (which may also be slightly trapezoidal) made of polyester felt is laminated with a heat seal to the front surface of the first layer 22. Decorative stitching 46 is then applied with an automatic computerized embroidery machine. The stitching 46 is preferably applied at the same time that stitching 40 is applied.

The back surface 20 of the pennant 10 has informational indicia thereon preferably including a label of authenticity 50 and a series label 52 which are preferably stitched onto the second layer 24, but also may be adhered thereto. In another embodiment all of the informational indicia occurs on one label such as the label 50. The second layer 24 also supports two tassel pairs 56 and 58 which are die cut from polyester felt and are sewn onto the second layer 24 at the same time a numbering label 60 is sewn onto the second layer. Overlaying the tassel pairs 56 and 58 is a back end strip 62 which is rectangular and which is preferably heat-sealed over the back surface 20 of the second layer 24. Optionally, there may be stitching around the periphery of the second layer 24 and through the strip 62. Since there is an intermediate stiffener 26, the stitching which holds the labels 50 and 52 may not visible to the front surface 18 of the first layer 22, unless the stitching is done after the first layer 20, second layer 24 and stiffener 26 are laminated or otherwise assembled together. The tassels are preferred, but optional.

A preferable method of assembly of pennant 10 includes laminating the layers 22 and 24 with thermoplastic layers 28 and 30 (see FIG. 3). The laminations comprised of layers 22 and 24 with the heat-sealed backings 28 and 30, respectively are then laid up in a multiplier with markers on top and are cut to the approximate size of the final pennant 10, for example approximately one inch larger then the final size along the final sides 12 and 14 and base edge 16.

The appliqués 34 and 35 and the labels 50 and 52, are cut slightly larger and then applied to the front surface 18 of the first layer 22 and to the rear surface 20 of the "second layer 24. The appliqués 34 and 35 are embroidered with the appropriate design and decorative stitching or are transfer printed on the surface 18. Appliques 34 and 35 are either single layered or multi-layered for a three-dimensional effect and are custom designed for each run of pennants 10 to suit the activity, event or person commemorated by the pennants or pennant. There may be single pennant 10, which for example may be used or rather presented, instead of a plaque.

The next step is to die cut the tassel pairs 56 and 58 and then, if desired, to embroider the end strips 42 and 44 with decorative stitching and/or designs and perhaps the series name and die cut them to a generally rectangular or slightly trapezoidal shape. The pennant 10 is then heat-sealed together with stiffener 26 disposed between the first layer 22 and the second layer 24 and with the thermoplastic backing sheets 28 and 30 disposed between the first and second layers respectively, and the stiffener. The resulting structure is then die cut to its final size using embroidered registration marks. The stitching 40 is then applied adjacent to peripheral of the pennant to add a decorative work and at the same time, to attach the tassel pairs 56 and 58 as well as the label 60 if they have not already been attached prior to lamination.

It is preferable to heat-seal the areas 34 and 35 to the front service 18 of the laminated pennant 10 if not already embroidered prior to the lamination step. The front and back end strips 42 and 62 are then heat-sealed to the surfaces 18 and 20 and the labels 50 and 52 are heat-sealed to the rear surface 20. The labels 50 and 52 may have been previously stitched to the back surface and it is preferable to have any even more finished look to heat-seal the labels 50 and 52 as well. It is of course also within this invention to only heat-seal the labels 50 and 52. If the front and back end strips 42 and 62 and the labels 50 and 52 are to be heat-sealed against the front and back surfaces 18 and 20 respectively, of the pennant 10, and it is necessary that the material comprising these components have a thermoplastic quality or backing.

An optional step with respect to pennant structure is to add a hangtag and pin to the pennant 10 and to number the pennant.

Figure 4:
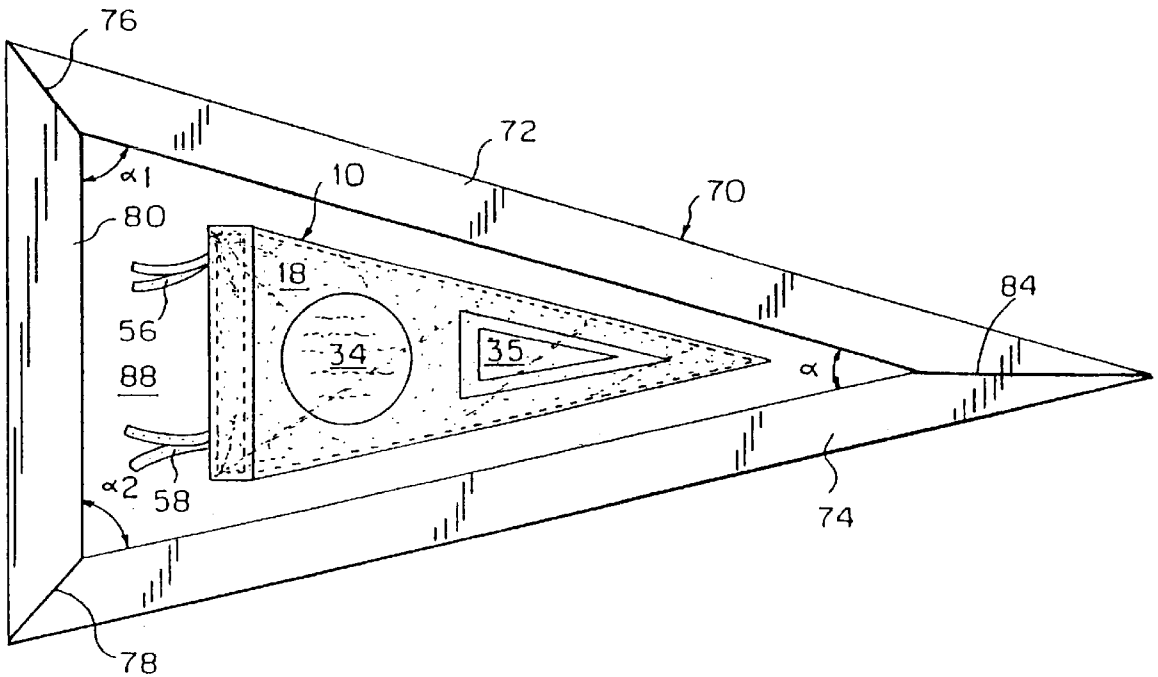
FIG. 4 is a view of the pennant of FIGS. 1–3 mounted in a triangular frame.

In a third aspect of the present invention, the pennant is optionally mounted in the pennant frame 70 of FIG. 4, which frame has a triangular shape. The triangular shape is preferably the same shape as the pennant 10, having base angles "$a_1$" and $a_2$" and an apex angle b that correspond to the apex angle of the pennant. The frame is comprised of two side members 72 and 74 which are joined at their diverging ends 76 and 78 by a base member 80. The junctions between the side members 72 and 74 and the base member 80 are mitered at an angle which is one-half the angles "$a_1$" and "$a_2$" while the junction between of the sides 72 and 74 is formed by a mitered joint which bisects the angle "b". A backing 88 is provided to support the pennant 10 and maybe a stiff backing material such as plastic, wood or fiberboard, but can be a made of fabric such as cloth fabric. The material 88 can be opaque or transparent; the advantage of being transparent is that the labels 50, 52 and 60 on the backside of the pennant 10, as well as the back surface 20 of the pennant are visible through the panel 88. The frame sides 72 and 74 and base 80 maybe made of any suitable material, for example wood or aluminum.

Figure 5:
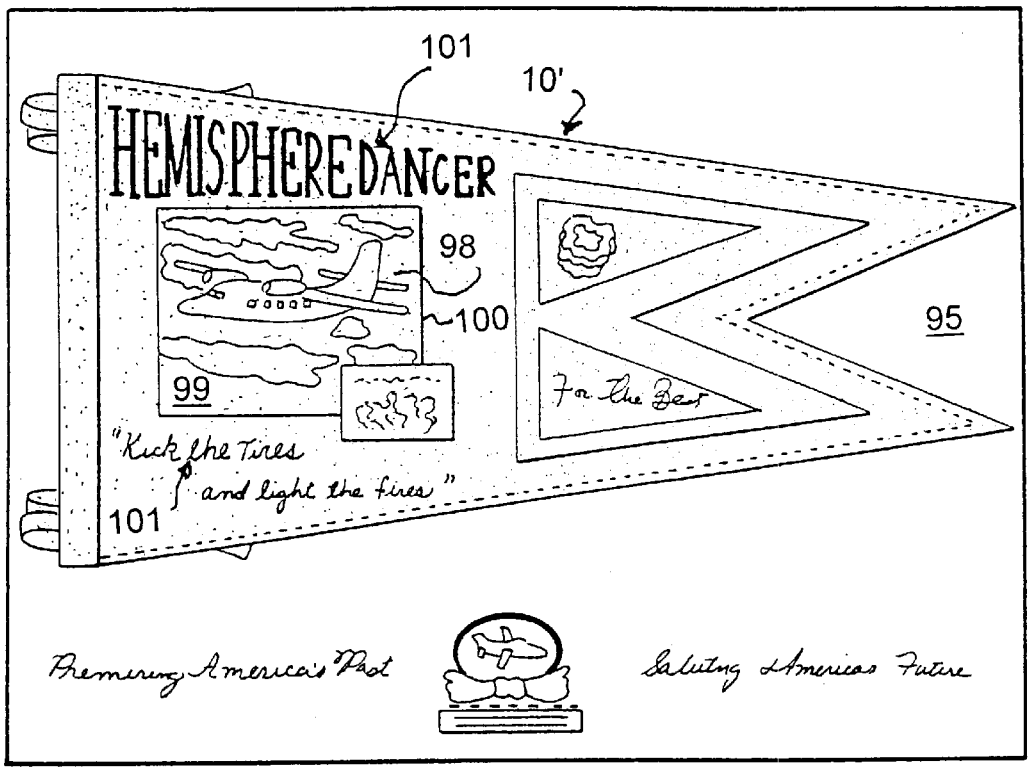
FIG. 5 is a front view of a pennant having a notched apex and displaying an embroidered photograph as well as other designs.
Figure 6:
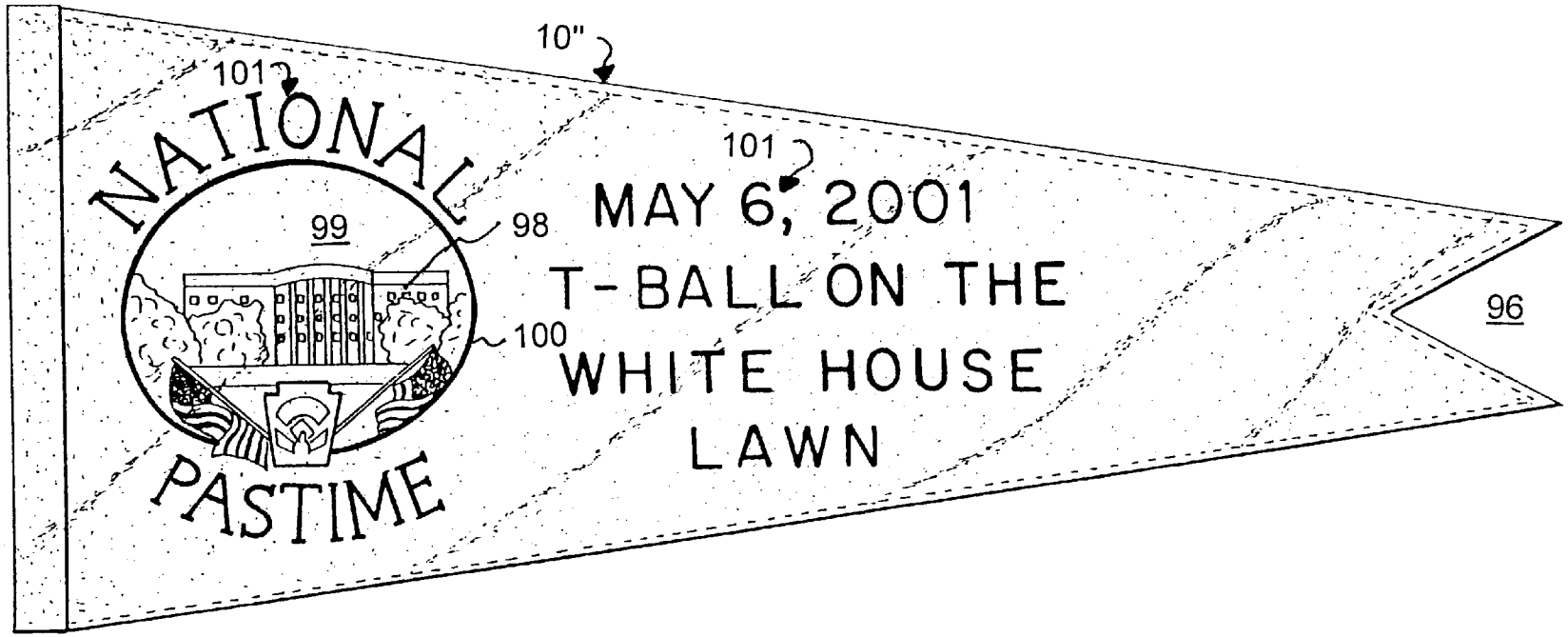
FIG. 6 is a front view of another pennant configuration with an embroidered photograph and a scripted message.

FIGS. 5 and 6 illustrate pennant embodiments 10' and 10" which have notched or "swallow-tailed" apecies 95 and 96, respectively. Each pennant 10' and 10" has a photograph reproduced as an embroidered image 98 on a patch embroidered around its periphery 100 with stitching extending through the stiffening layer 26 (see FIG. 3) and covered by the second layer 24 (see FIG. 3) so as not to be visible from the back of the pennants 10' and 10". The pennants 10' and 10" also have text 101 embroidered thereon, the stitching of which passes through the stiffener 26 (FIG. 3) and is covered by the second layer 24 (FIGS. 2 and 3).

Figure 7:
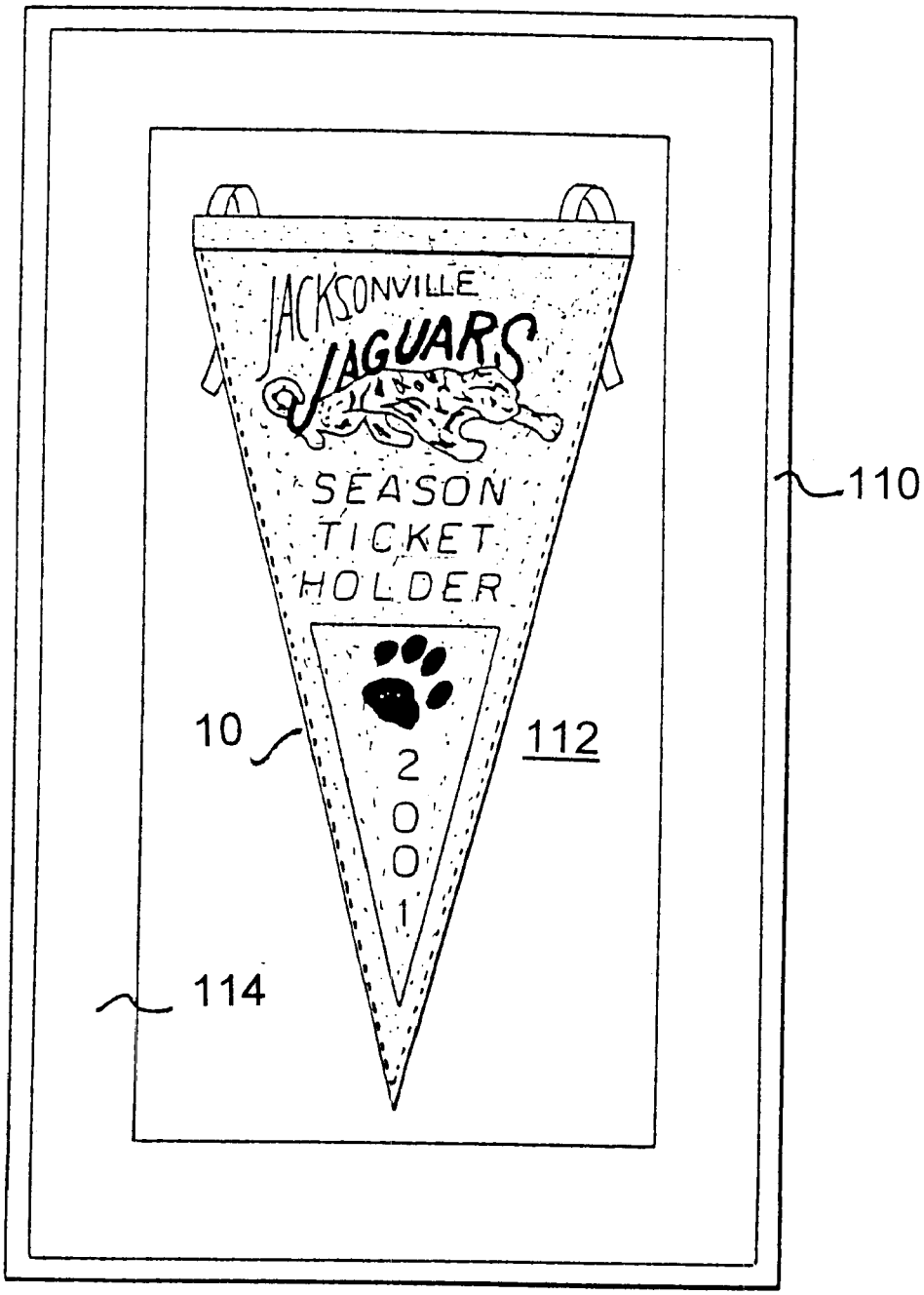
FIG. 7 is a front view of a pennant in a rectangular frame.

FIG. 7 illustrates a pennant 10 mounted in a rectangular frame 110 on a backing 112 within matting 114. In the arrangement of FIG. 7, the tassels 56 and 58 are folded under the pennant 10. In a preferred embodiment, the pennant 10 and matting 114 is covered by glass, but may be left exposed.

It is to be kept in mind that the pennants 10 may be of various sizes from seven inches to several feet or longer.

In order to sustain the value of pennants 10, each pennant has a number on the label 60, making that pennant unique. The label 50 includes authenticating data and identifies the particular series of which the pennant is part, while the label 52 identifies the series. Information regarding each pennant 10 is maintained in a computerized data bank at the premises of the manufacturer so there is a permanent record of each pennant 10 produced. The computerized records also include an official authorization statement by the entity which endorses the pennant so that each pennant carries the value of a specific recognition of its commission and design. For example, if a nationally recognized golf tournament has authorized the production and distribution of pennant 10, then the owner of a pennant who has purchased that pennant can be assured that the pennant is considered official.

Without further elaboration, it is believed that one skilled in the art can, using the preceding description, utilize the present invention to its fullest extent. The proceeding preferred specific embodiments are; therefore, to be construed as merely illustrative, and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

I claim:

1. A pennant suitable as a keepsake and collectors item comprising:

a substantially triangular shape defined by a base edge and a pair of converging sides extending from the base edge;

a first layer having a front surface to which a displayed design with a peripheral area is affixed by stitches passing through at least the peripheral area of the displayed design and having, a back surface covered by a first thermoplastic backing sheet a second layer having a rear surface on which pennant information occurs, the second layer having a front surface covered by a second thermoplastic backing sheet, and a stiffener layer of woven polyester disposed between the first layer and second layer, the stiffener layer being bonded by the first and second thermoplastic backing sheets to the first and second layers.

2. The pennant of claim 1 wherein the first layer is made of polyester felt.

3. The pennant of claim 1 wherein the displayed design is disposed in at least one decorative area on the first layer and wherein the decorative area is applied thereto as a direct embroidery, an embroidered appliqué, a sublimation or a transfer.

4. The pennant of claim 3 wherein any indicia on the back surface of the first layer is covered by the stiffener layer so as not to be discernable in the second layer either visually or tactically.

5. The pennant of claim 4 wherein the pennant information includes authenticating data identifying a particular series of which the pennant is part.

6. The pennant of claim 4 wherein the data is on labels stitched or adhered to the second layer.

7. The pennant of claim 6 wherein the data includes authenticity data and series data.

8. The pennant of claim 7 further including a label fixed to the rear surface by stitching at one end thereof beneath an end strip affixed to the rear surface.

9. The pennant of claim 8 wherein associated with the pennant is a computerized data bank including an official authorization statement by an entity endorsing the pennant, a number assigned to the pennant and series data identifying the series of which the pennant is part.

10. The pennant of claim 1 wherein the display is an embroidered image or a photograph or other art work which is in the form of a patch, the patch being embroidered around the periphery thereof to the first layer by stitching which passes through the periphery and through the stiffener layer, the second layer being placed over the stitching to obscure the stitching.

11. The pennant of claim 1 wherein the pennant is in combination with a triangular frame comprised of a backing and three frame members, the three frame members comprising a base and two side members.

12. The pennant in combination with the frame of claim 11 wherein the pennant is triangular with a base and two sides which define two base angles and an apex angle where joined, and wherein the triangular frame has three mitered joints which extend at angles which are one half the angles of the pennant.

13. The pennant in combination with the frame of claim 12 wherein the backing is transparent.

14. The pennant of claim 1 wherein the pennant has a V-shaped bifurcated apex with two projecting points.

15. The pennant of claim 1 wherein the pennant is in combination with a rectangular frame comprised of a backing and four frame members.

16. The pennant of claim 1 wherein the displayed design is an appliqué having an embroidered image thereon.

17. The pennant of claim 16 wherein the image is a photograph or graphic artwork reproduced by embroidering on the appliqué.

18. The pennant of claim 17 wherein the appliqué is fixed by an adhesive.

19. The pennant of claim 16 wherein the appliqué is fixed by stitching around the periphery of the appliqué.

20. The pennant of claim 19 wherein the stitching is embroidery.

21. The pennant of claim 1 wherein the displayed design is a photographic image on a patch which is embroidered around the periphery thereof.

22. The pennant of claim 21 wherein the stitching comprising the embroidery around the patch passes through the periphery and through the stiffener layer, the second layer being placed over the stitching to obscure the stitching.

23. The pennant of claim 1 wherein the first layer is made from a material selected from the group consisting of polyester felt, wool, polyamide, wool blend, leather, cotton and silk.

24. The pennant of claim 1 in combination with a rectangular frame and a backing wherein the pennant is mounted on the backing.

25. In combination:

a triangular shaped pennant having a base edge and two converging sides extending from the base edge, the triangular shaped pennant having first and second layers bonded by thermoplastic sheets to a stiffener layer of woven polyester, the first layer having a surface with a displayed design, stitches passing through at least a peripheral area of the displayed design and at least the first layer to fix the displayed design to the first layer, and a triangular frame comprised of a backing and three frame members, the three frame members comprising a base and two side members, the triangular shaped pennant being mounted within the triangular frame.

26. The pennant in combination with the frame of claim 25 wherein the triangular pennant has a base and two sides, which two sides define two base angles and an apex angle where joined, and wherein the triangular frame has three mitered joints which extend at angles which bifurcate the angles of the pennant.

27. The pennant in combination with the frame of claim 26 wherein the backing is transparent.

* * * * *

UNITED STATES PATENT AND TRADEMARK OFFICE

CERTIFICATE OF CORRECTION

PATENT NO. : 6,598,558 B2
DATED : July 29, 2003
INVENTOR(S) : Tom Griffin

It is certified that error appears in the above-identified patent and that said Letters Patent is hereby corrected as shown below:

Column 6,
Line 5, reads “collectors” should read -- collector’s --
Line 44, reads “claim 8” should read -- claim 6 --

Signed and Sealed this

Twenty-second Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,598,558 B2
DATED : July 29, 2003
INVENTOR(S) : Tom Griffin

It is certified that error appears in the above-identified patent and that said Letters Patent is hereby corrected as shown below:

Column 6,
Line 5, reads “collectors” should read -- collector’s --
Line 44, reads “claim 8” should read -- claim 6 --
Line 50, reads “image or a photograph” should read -- image of a photograph --.

This certificate supersedes Certificate of Correction issued March 22, 2005.

Signed and Sealed this

Twenty-sixth Day of July, 2005

JON W. DUDAS
*Director of the United States Patent and Trademark Office*